US005088844A

United States Patent [19]

Takeuchi et al.

[11] Patent Number: 5,088,844

[45] Date of Patent: Feb. 18, 1992

[54] IMPACT DOT PRINT HEAD AND PRINTER INCLUDING SAME

[75] Inventors: Takashi Takeuchi; Toshio Kuriyama, both of Suwa, Japan

[73] Assignee: Seiko Epson Corporation, Tokyo, Japan

[21] Appl. No.: 479,901

[22] Filed: Feb. 14, 1990

[30] Foreign Application Priority Data

Feb. 16, 1989 [JP] Japan ..... 1-36620

[51] Int. Cl.[5] ..... B41J 2/24

[52] U.S. Cl. ..... 400/124; 101/93.05; 267/141

[58] Field of Search ..... 400/124; 267/139, 140, 267/140.3, 140.4, 141, 141.1; 101/93.05

[56] References Cited

U.S. PATENT DOCUMENTS 3,814,412 6/1974 Britton et al. ..... 267/156
4,594,010 6/1986 Jachno ..... 400/124
4,600,321 7/1986 Kwan ..... 400/124

FOREIGN PATENT DOCUMENTS 2524825 1/1976 Fed. Rep. of Germany ..... 267/139
0297153 12/1986 Japan ..... 400/124

*Primary Examiner*—Edgar S. Burr
*Assistant Examiner*—Christopher A. Bennett
*Attorney, Agent, or Firm*—Blum Kaplan

[57] ABSTRACT

A printer including an impact dot print head for driving a plurality of print wires mounted on the cantilevered end of print levers is provided. The print head includes a stopper positioned to be impacted by a print lever returning from a print position to an at rest position before a plunger on the lever impacts the magnetic core. A spring mounted on the lever biases it towards the print position. Magnetic flux of a permanent magnet attracts the plunger to the non-print position. An electromagnetic coil is energized to cancel the magnetic attraction of the plunger to the core to drive the wire towards the print position.

4 Claims, 5 Drawing Sheets

IMPACT DOT PRINT HEAD AND PRINTER INCLUDING SAME

BACKGROUND OF THE INVENTION

This invention relates generally to an impact printer, and in particular, to an impact dot print head in which printing is effected by striking the tips of printing wires against an ink ribbon.

Impact dot print heads are well known in the art. Generally, in the non-printing state a plunger is held in direct contact with a magnetic core or in contact with a spacer disposed between the plunger and the magnetic core. The plunger is attracted to the core by the magnetic flux of a permanent magnet.

In these impact dot print heads, when the plunger returns to the non-printing (standby) position following a printing operation, the plunger forcibly collides with the core or collides with the spacer which collides with the core. Thus, the plunger and the core are subjected to harsh abrasion and must be replaced frequently. Generally, the materials with good mechanical strength do not have good magnetic qualities. Thus, an impact dot print head including a plunger and a core formed of a high strength material and which resists abrasion would lack good magnetic properties and reduce the efficiency of the magnetic circuit. If the spacer is thickened to absorb the force of the collision, the efficiency of the magnetic circuit also declines. Accordingly, the thickness of the spacer is limited and increasing the space between the core and the plunger is not adequate.

Accordingly, it is desirable to provide an impact dot printer including an impact dot print head in which abrasion of the plunger and core is reduced without sacrificing the efficiency of the magnetic circuit and avoids the disadvantages of the prior art devices described above.

SUMMARY OF THE INVENTION

Generally speaking, in accordance with the invention, an impact dot print head having a plunger secured to a spring for controlling displacement of a print wire with the plunger attracted by the magnetic flux of a permanent magnet to bias the spring to maintain it in a standby position. A stopper is provided to restrict displacement of the plunger towards the magnetic core to avoid contact with the magnetic core. At the time of printing, a coil wound around the core is energized to cancel the attraction of the plunger to the core. The print wire connected to a lever secured to the spring is biased towards the print medium by the biasing force of the spring.

When the print lever collides with the stopper as it returns to the non-printing position, most of the kinetic energy is absorbed by the stopper and the collision between the plunger and the core or between the plunger and the spacer which collides with the core is reduced. Thus, the plunger and the core are less susceptible to abrasion and elastic deformation even when a soft magnetic material with excellent magnetic properties is used. In one embodiment of the invention, the stopper has a laminated structure including a resin film portion, a metallic portion provided with slits to impart resiliency and a rubber portion for absorbing kinetic energy.

Accordingly, it is an object of the invention to provide an improved impact dot print head.

Another object of this invention is to provide an improved impact dot print head which reduces abrasion of the plunger and the magnetic core without sacrificing the efficiency of the magnetic circuit.

A further object of the invention is to provide an improved impact dot print head which includes a stopper for absorbing impact when the print lever is returned to the standby position.

Yet another object of the invention is to provide an improved impact dot print head in which the plunger and the magnetic core do not have to be frequently replaced.

Yet a further object of the invention is to provide a stopper for an impact dot print head which will absorb kinetic energy from a print lever as it is returned to its standby position.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 6:
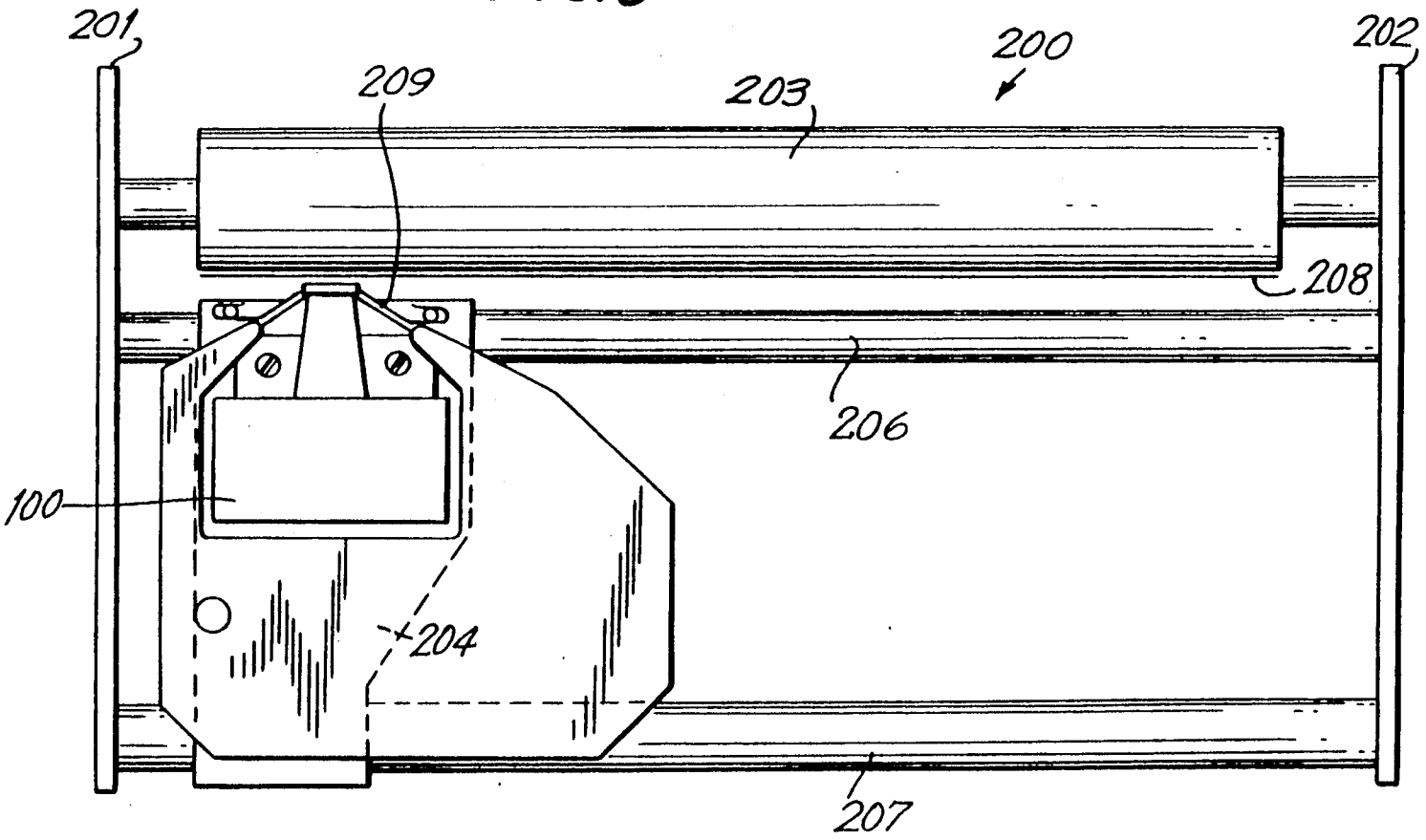
FIG. 6 is a top plan view of an impact printer including an impact dot print head constructed in accordance with the invention.

FIG. 6 illustrates a printer, generally indicated as 200 including an impact dot print head 100 constructed in accordance with the invention. Printer 200 includes a platen 203 rotably supported between side frames 201 and 202. A carriage 204 is supported within side frames 201 and 202 and is slideably mounted on an inner slide 206 and an outer slide 207 for travel in a direction of print columns along platen 203. Impact dot print head 100 is mounted on carriage 204 for displacement across platen 203. The desired patterns, characters and the like are printed on a recording medium, such as a print paper 208 positioned between platen 203 and an ink ribbon 209.

Figure 1:
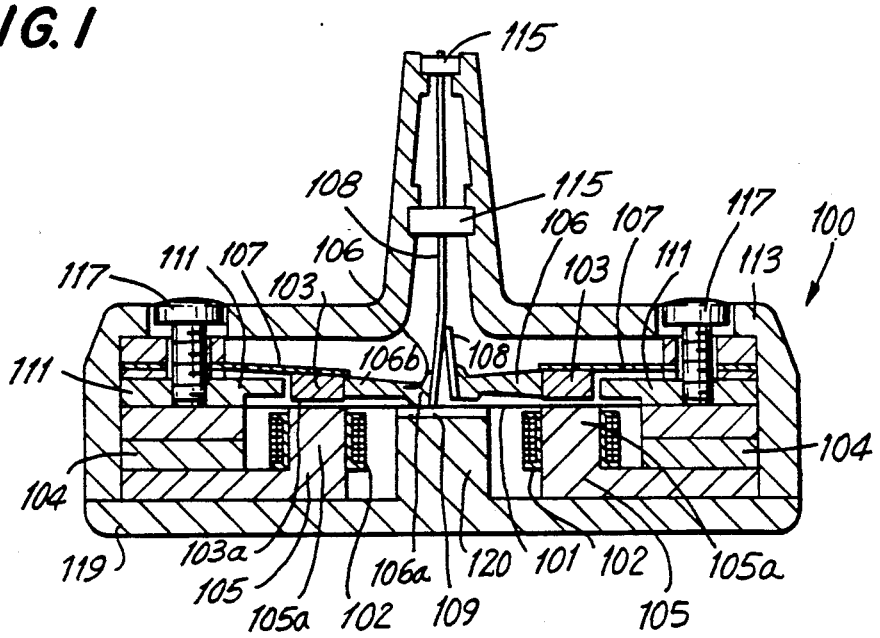
FIG. 1 is a cross-sectional view of an impact dot print head constructed and arranged in accordance with the invention.

Referring now to FIG. 1, a cross-sectional view of impact dot print head 100 is shown. The left side of FIG. 1 illustrates the elements of print head 100 in the non-printing (standby) position in which an electromagnetic coil 102 is not energized. The right side of FIG. 1 illustrates the printing position in which electromagnetic coil 102 is energized.

Impact dot print head 100 includes a plurality of print levers 106 positioned within impact dot print head 100 in a ring pattern. Print head 100 is defined by a guide frame 113 and a head back 119 formed with a central internal projection 120. The same number of print levers 106 are positioned within print head 100, each lever 106 of the cantilever type with a free or distal end 106*a* and a secured or proximal end 106*b*. Wires 108 are held by a wire guide 115. A printing wire 108 is supported on distal end 106*a* of a respective print lever 106.

A plunger 103 having an end surface 103*a* is affixed on a proximal end 106*b* of print lever 106. A spring 107 is mounted along proximal portion 106*b* to mid-portion 106*c* of lever 106. Spring 107 and lever 106 are secured to a yoke 111 by a bolt 117. A plunger 103 is mounted on the back side of each lever 106.

A ring shaped permanent magnet 104 and a ring shaped base core 105 with projections 105*a* are mounted in guide frame 113. An electromagnetic coil 102 is wound about each core projection 105*a* to form an electromagnet for each print wire.

A stopper 109 is mounted on projection 120 of back 119 so that distal portion 106*a* of lever 106 contacts stopper 109 when lever 106 is in the standby position as shown on the left side of FIG. 1. A spacer 101 is positioned across the top surface of stopper 109 on the projection 120 and extends between plunger 103 and core projections 105*a*.

Figure 2:
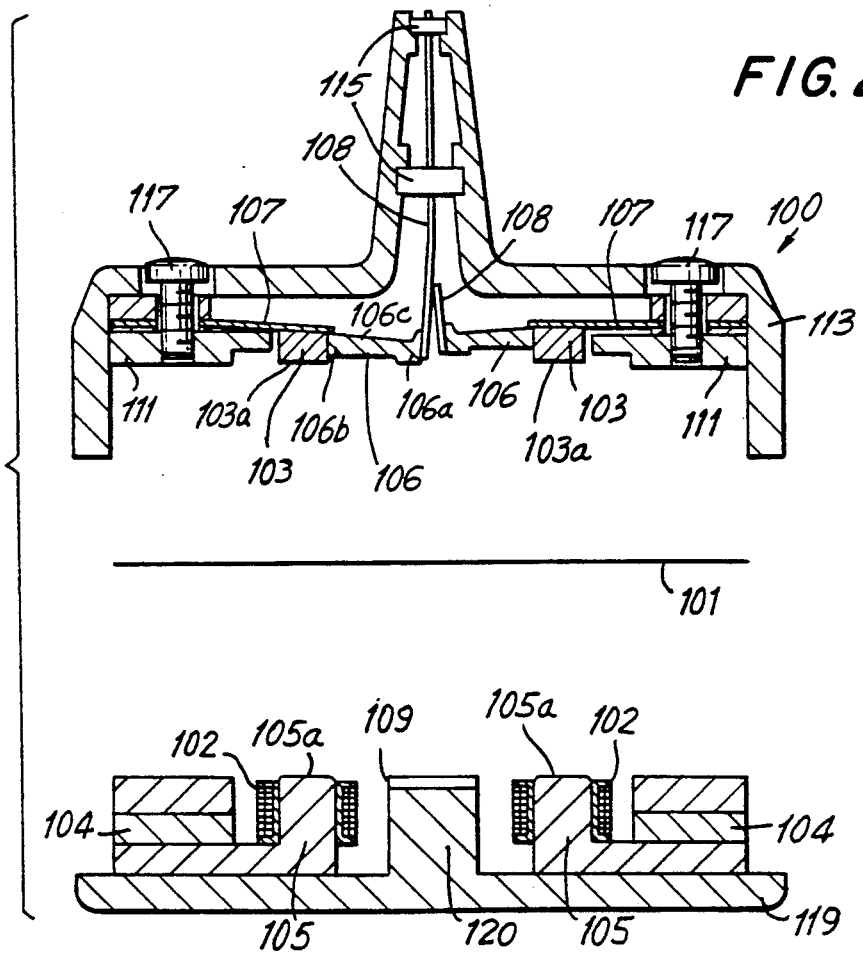
FIG. 2 is an exploded cross-sectional view of the impact dot print head of FIG. 1.

FIG. 2 shows impact dot print head 100 with back 119 separated from guide frame 113 to free spacer 101. In the non-printing position plunger 103 is attracted toward core 105 by the magnetic flux of permanent magnet 104 and biases spring 107. Stopper 109 prevents lever 106 from advancing towards back 119 before plunger 103 contacts projection 105*a*.

During printing electromagnetic coil 102 is energized to cancel the attraction of plunger 103 towards core 105 and causes print wire 108 to spring forward due to the biasing force of spring 107.

Printing is performed by print wire 108 impacting ink ribbon 209 and paper 208. When energization of electromagnetic coil 102 is complete after printing, plunger 103 is again attracted by the magnetic flux of permanent magnet 104 and lever 106 returns to the standby position and collides with stopper 109 before plunger 103 impacts spacer 101 and core 105. Stopper 109 absorbs the kinetic energy and stopper 109 is elastically deformed.

Figure 3:
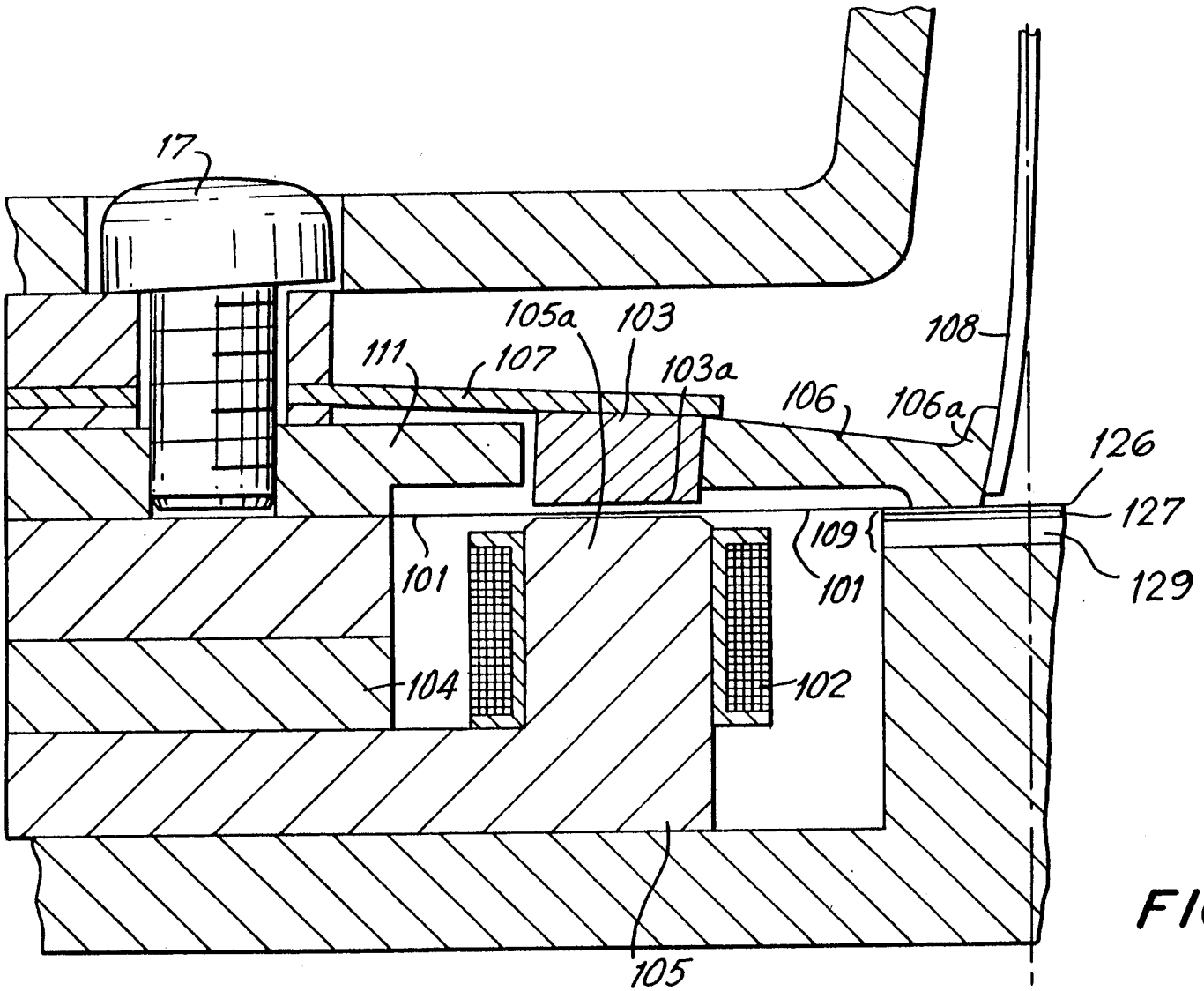
FIG. 3 is an enlarged view of a portion of the print head of FIG. 1 showing the print lever in an at rest position.
Figure 4:
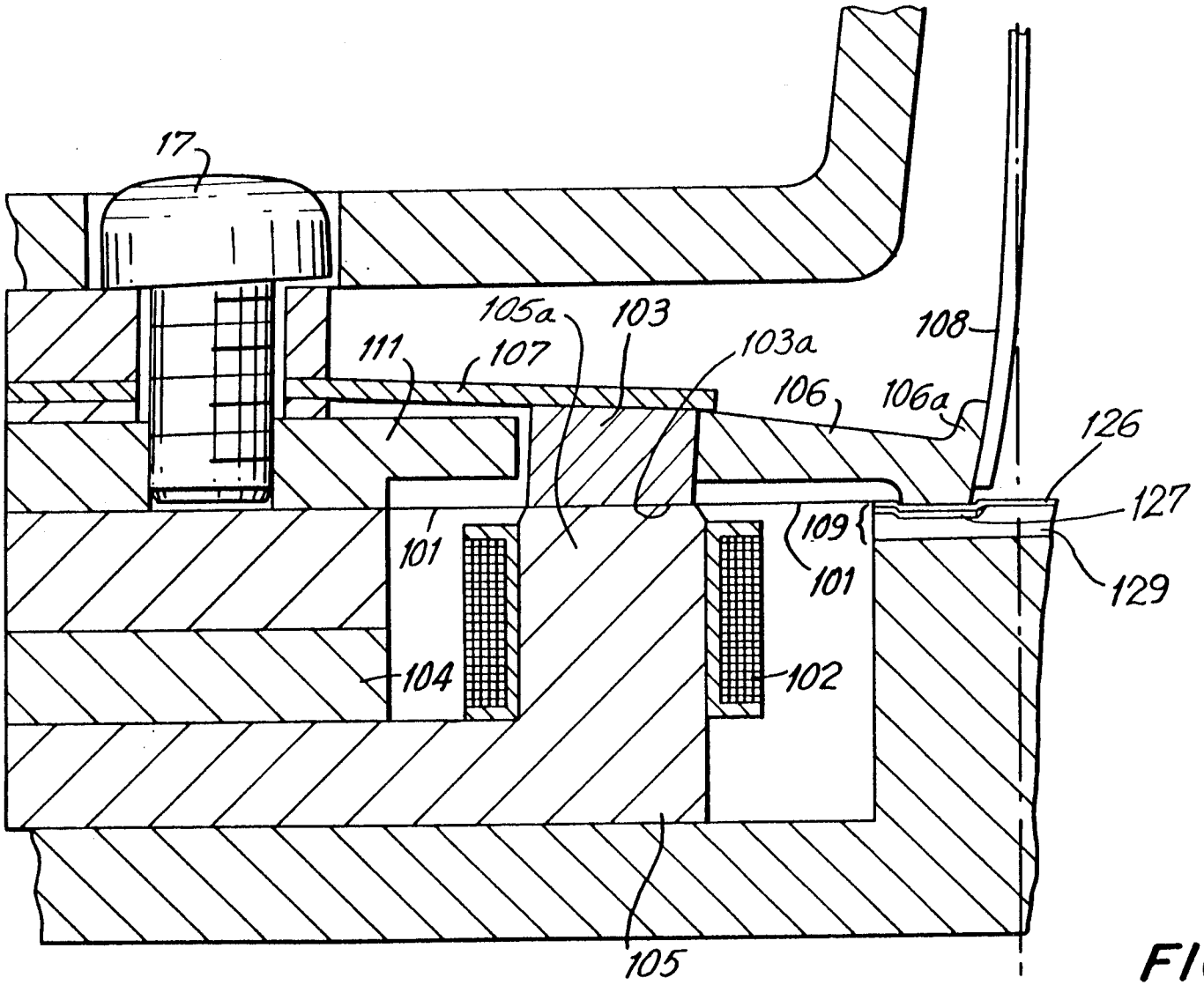
FIG. 4 is an enlarged view of a portion of the print head of FIG. 1 illustrating a stopper subjected to elastic deformation as the lever returns to the at rest position.

FIG. 4 illustrates the elastic deformation of stopper 109 which results when distal end 106*a* of lever 106 returns to the at rest position after printing. At this time, plunger 103 contacts spacer 101 and core projection 105*a*. Since most of the kinetic energy from the collision of lever 106 and stopper 109 is absorbed by stopper 109, the impact of the collision between plunger 103, spacer 101 and core 105 is small and it is possible to prevent harsh abrasion of core 105 and plunger 103. Thus, it is not necessary to form core 105 and plunger 103 of an abrasion resistant material which tends to have poor magnetic qualities. Accordingly, core 105 and plunger 103 can be formed of a soft magnetic material having relatively low mechanical strength, but excellent magnetic properties. Following the collision of lever 106 and stopper 109, stopper 109 recovers from elastic deformation shown in FIG. 4 and returns to the non-printing (standby) position shown in FIG. 3.

Figure 5:
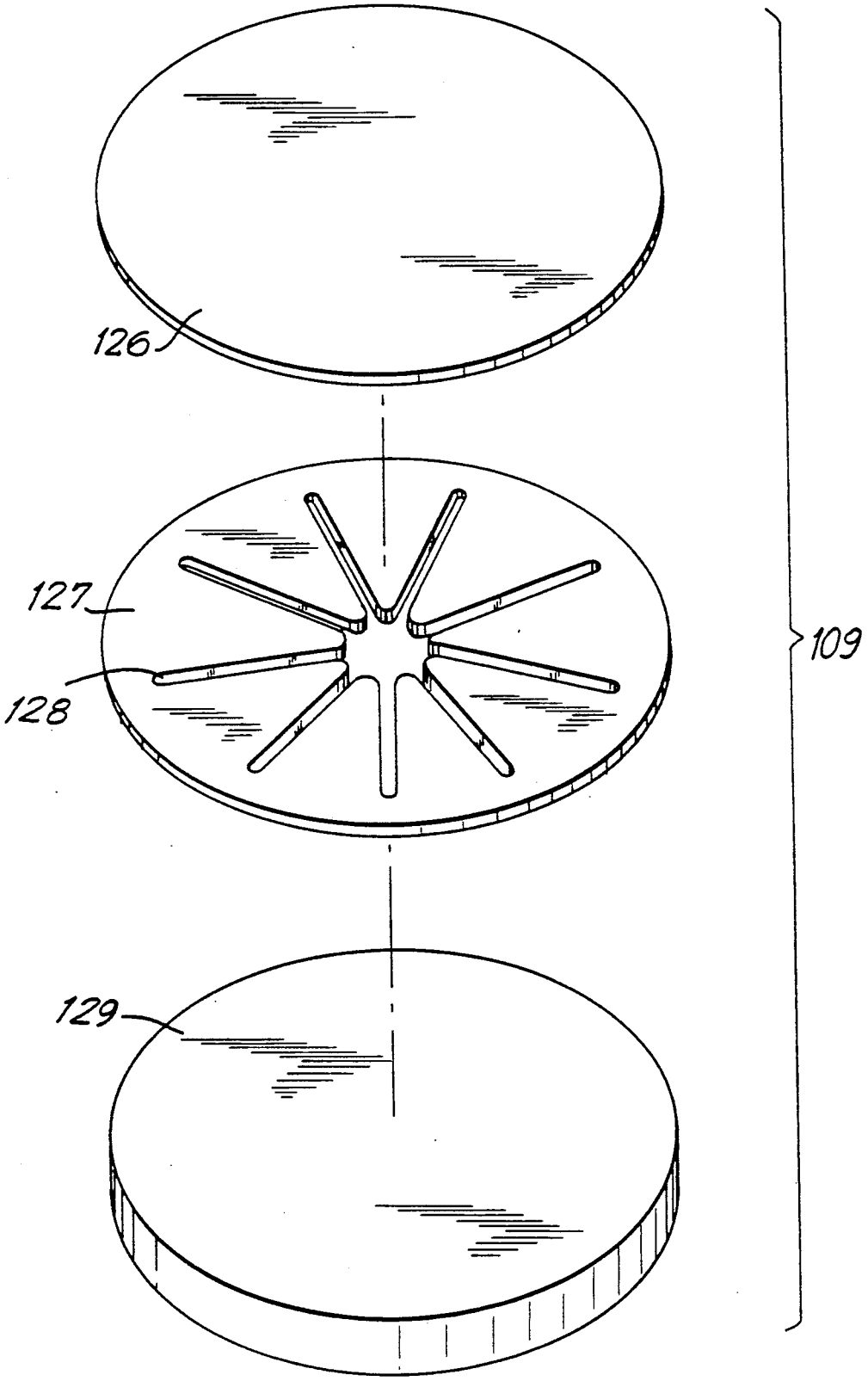
FIG. 5 is an exploded perspective view of a stopper constructed in accordance with the invention.

The construction of stopper 109 is shown in FIG. 5. Stopper 109 is a laminated structure including a resin film layer 126, a metallic layer 127 which is formed with slits 128 to impart resilience and a rubber layer 129 which absorbs kinetic energy. This construction enables stopper 109 to absorb the kinetic energy produced by the collision of lever 106 and stopper 109.

In an exemplary embodiment of impact dot print head 100, the gap between surface 103*a* of plunger 103 and surface 105*b* of core projection 105*a* in the non-printing (standby) position is 0.03 mm. Spacer 101 is 0.02 mm thick. Spacer 101 is not required if two conditions are satisfied. First, if in the non-printing (standby) position, the gap between surface 103*a* of plunger 103 and surface 105*b* of core 105 is large enough so that the effect of a drop in the efficiency of the magnetic circuit is small. And, second, if surface 103*a* of plunger 103 and surface 105*b* of core 105 do not contact each other when stopper 109 is subjected to elastic deformation as it is impacted by lever 106.

In summary, in a printer including the impact dot print head constructed in accordance with the invention, most of the kinetic energy is absorbed by the stopper when the print lever collides with the stopper as the print lever returns to the non-printing position. The collision between the plunger and the core or between the plunger and the spacer which collides with the core is reduced and the plunger and the core are less susceptible to abrasion and elastic deformation even when a soft magnetic material is used. Thus, the efficiency of the magnetic circuit is not sacrificed and the plunger and the core do not have to be frequently replaced.

It will thus be seen that the objects set forth above, among those made apparent from the proceeding description are efficiently attained, and since certain changes may be made in the above construction without departing from the spirit and scope of the invention, it is intended that all matter contained in the above description and shown in the accompanying drawings shall be interpreted as illustrative and not in a limiting sense.

It also to be understood that the following claims are intended to cover all of the generic and specific features of the invention herein described and all statements of the scope of the invention which, as a matter of language may be said to fall therebetween.

What is claimed is:

1. An impact dot printer, comprising an impact dot print head including a plurality of lever means mounted in the print head biased towards a print position, a print wire mounted on the free end of each lever means, a plunger mounted to said lever means, a permanent magnet for attracting said plunger to a stand-by position, electromagnetic means associated with a respective lever means to cancel the attractive force of the permanent magnet to permit the print wire to be displaced towards said print position and stopper means for restricting the displacement of said lever means as it returns to the at rest position so that the lever means impacts the stopper means before the plunger contacts the electromagnet means, said stopper means including a metallic layer, a resin film layer on one surface of the metallic layer, and a rubber layer on the opposite surface of the metallic layer.

2. The impact dot printer of claim 1, wherein said metallic layer is formed with slits to impart resiliency.

3. A stopper for an impact dot printer head, comprising a metallic layer, a resin film layer on one surface of the metallic layer and a rubber layer on the opposite surface of the metallic layer, said metallic layer, resin film layer and rubber layer all disk-shaped and exposed at their circumferential edges.

4. The stopper of claim 3, wherein the metallic layer is formed with slits for an impacting resiliency to the stopper.

* * * * *